US005339760A

United States Patent [19]

Korsgaard

[11] Patent Number: 5,339,760

[45] Date of Patent: Aug. 23, 1994

[54] APPARATUS FOR SECURING A VESSEL TO A SUBMERSIBLE MOORING BUOY

[76] Inventor: Jens Korsgaard, 318 N. Post Rd., Princeton Junction, N.J. 08550

[21] Appl. No.: 124,136

[22] Filed: Sep. 20, 1993

[51] Int. Cl.[5] ..... B63B 21/00

[52] U.S. Cl. ..... 114/230; 441/3; 114/293

[58] Field of Search ..... 403/321, 322; 405/195.1; 166/352–354; 175/7, 8; 285/920, 298, 302; 204/82.32; 114/230, 293; 441/3–5

[56] References Cited

U.S. PATENT DOCUMENTS 4,604,961 8/1986 Ortloff et al. ..... 114/230

OTHER PUBLICATIONS

OTC Publication No. 6251 May 1990.

*Primary Examiner*—Edwin L. Swinehart
*Attorney, Agent, or Firm*—Kenyon & Kenyon

[57] ABSTRACT

A vessel with a downward-facing mooring part moors to a submerged buoyant mooring element anchored to the ocean bottom by hoisting the mooring element from a stowed position, at a depth of net neutral buoyancy of the mooring element and its anchoring system, until a mating upper part of the mooring element comes into contact with the mooring part. The mooring operation is completed safely, quickly, and positively by securing the mooring element to the vessel with a multiplicity of hooks that are lowered by actuators mounted in the vessel to engage a mooring ring on the upper part of the mooring element and are then raised to exert a predetermined compression force on a resilient compression member. The mooring part may include a turret rotatably mounted in the vessel, or the mooring element may have an upper part that makes sealing contact with the hull of the vessel and a lower part that is rotatable with respect to the upper part and is connected to the anchor lines, so that the vessel may weather vane in response to wind, wave, and current forces.

9 Claims, 4 Drawing Sheets

APPARATUS FOR SECURING A VESSEL TO A SUBMERSIBLE MOORING BUOY

BACKGROUND OF THE INVENTION

1. Field of the Invention

This invention relates generally to the mooring of tankers or other vessels in unprotected waters. More particularly, the invention relates to a mooring system which combines a submerged buoyant mooring element anchored to the seabed by catenary lines and a vessel provided with a hoisting apparatus for raising the mooring element to the vessel and apparatus for securing the vessel to the mooring element independently of the hoisting apparatus.

2. Background Art

In recent years, a number of undersea oil and gas fields have been developed in offshore areas that are subject to extreme weather conditions. Oil or gas is typically delivered from a wellhead on the sea floor to a semi-permanently moored converted tanker or to a special purpose vessel known as a floating storage and off-loading (FSO) vessel or a floating production storage and off-loading (FPSO) vessel. These vessels are designed to remain on station permanently, unless oncoming severe storms or ice floes threaten damage to or loss of the vessel. In such an event, the well is shut in and the vessel is unmoored and sails or is towed away. Upon passing of the storm or ice floe condition, the vessel returns and is again moored above the wellhead.

A typical mooring system, such as is described, for example, in U.S. Pat. Nos. 4,604,961 and 4,892,495, includes a buoyant mooring element that is connected to the wellhead by a flexible pipe and to the sea floor by a number of angularly spaced catenary lines. The system is arranged so that the weight of the portions of the catenary lines that are not resting on the sea bottom counteracts the buoyancy of the mooring element to maintain it normally at a predetermined submerged depth, called the stowed position, when no vessel is moored to it. This assures that the mooring element will not be a navigation hazard or be damaged by a collision.

Mooring is accomplished by pulling the submerged mooring element up to the vessel and securing it rigidly by mechanical latching or clamping devices to a rotary turret mounted in a recess or well in the bottom of the vessel. The securing apparatus must withstand separating forces acting between the vessel and the mooring element during higher sea states than the maximum sea state that will permit the mooring operation. The connecting elements of the securing apparatus thus need to be large and heavy and to be precision made so as to mate perfectly for avoiding stress concentrations. Not only does the requirement for precision increase the time to fabricate the securing apparatus and its cost, but also the relatively close fit between the components on the vessel and those on the mooring element demands careful alignment of the mating surfaces during mooring. Thus, this operation can take place only in a relatively low sea state, and the time required to wait for the sea state to subside after the storm has passed is additional lost production time from the field.

Another problem with the present technology is the possibility of damage to the vessel or the mooring element during the mooring operation because a relatively long time is required to secure the mooring element to the turret after the hoist line has brought the mooring element close to the vessel bottom. During this time a number of rolling and pitching cycles of the vessel may take place in even moderate sea states, and these movements can result in multiple collisions between the vessel and the mooring element, causing bending and denting of the mating surfaces.

Finally, unmooring usually is accomplished by releasing the latching or clamping connectors while they are under load. This procedure also has an inherent risk of structural deformation and damage to the connectors, particularly if there is any binding or delay in releasing some of the connectors during disconnect. Repairs to damaged mechanical mooring components can mean additional weeks of costly oil field production shutdown.

SUMMARY OF THE INVENTION

An object of the present invention is to provide an improved mooring system of the above described type that provides rapid and secure engagement of a buoyant mooring element with the vessel.

Another object of the invention is to reduce the possibility of damage to the vessel or the mooring element from collisions that occur during the mooring procedure.

A further object of the invention is to reduce the precision in manufacture and closeness of fit required of the mooring element and the mooring components on the vessel so that mooring can be accomplished more quickly and with less risk of damage, and so that the securing apparatus can accommodate normal deformations of the mooring system structure under design conditions of sea state, wind, and current.

A further object of the invention is to provide apparatus that includes multiple connecting elements for securing a vessel to a submersible mooring buoy so that damage to one or a few connecting elements will not result in failure of the mooring connection.

Yet another object of the invention is to provide apparatus for compressively securing an upper part of a submersible mooring buoy to a downward-facing mooring part of a vessel such that the connection will remain in compression despite changes in the anchoring forces acting on the mooring element as the result of wind and wave forces acting on the vessel.

A still further object of the invention is to provide securing apparatus that can be remotely actuated; so that for safety reasons, no personnel are required in the vicinity of the mooring connection.

The above and other objects are achieved with the present invention by an ocean mooring system including a submersible buoyant mooring element having an upper part symmetrical about a vertical mooring axis of the mooring element, the mooring element being normally maintained at a preselected stowed depth; a vessel having a downward-facing mooring part symmetrical about a mooring axis of the vessel and engageable with the upper part of the mooring element; means for hoisting the mooring element from the preselected depth into engagement with the mooring part of the vessel; and apparatus for securing the upper part of the mooring element to the mooring part of the vessel, wherein the securing apparatus comprises:

a downwardly-facing annular mooring surface on the upper part of the mooring element coaxial with the mooring axis of the mooring element;

a multiplicity of actuators mounted in the vessel;

a multiplicity of hooks disposed concentrically with the mooring axis of the vessel, at least one hook being connected to each actuator for movement by the actuator between a raised position and a lowered position; and apparatus for radially shifting each hook in one direction to engage the mooring surface during a mooring operation and in an opposite direction to disengage from the mooring surface during an unmooring operation, wherein the multiplicity of actuators, when actuated to move their respective hooks to the raised position when the hooks are engaged with the mooring surface, exert a total tension force that is greater than a predetermined maximum downward force exerted by the mooring element on the hooks.

Preferably at least one, and possibly both, of the mooring part of the vessel and the upper part of the mooring element includes a resilient compressible member that cushions any impact of the upper part of the mooring element against the mooring part of the vessel to avoid or minimize damage to the two parts. Preferably the resilient member makes a circle of sealing contact with the mooring part of the vessel so that seawater can be pumped out of any vessel spaces open to the mooring part after the mooring element is secured to the vessel.

It is further desirable that the multiplicity of actuators and hooks of the securing apparatus have an effective total tensile elasticity that is greater (i.e., lower spring constant) than the compressive elasticity of the compressible member to insure that each of the hooks maintains its force on the mooring ring while more hooks are engaged, and thereby further compresses the resilient compressible member.

As in the previously described prior art mooring systems, the mooring element may be secured to a turret that is rotatably mounted in the vessel; in which case the vessel may weather vane by rotating about the turret. If the vessel has no turret, the mooring element desirably has a lower part that is rotatable relative to the upper part about a vertical axis. In the latter case, the vessel is moored to the upper part and the anchor lines are fixed to the lower part, thereby permitting the vessel to weather vane.

The above and other features and advantages of the mooring system of the invention are described in detail below in connection with the drawings.

DETAILED DESCRIPTION OF THE PREFERRED EMBODIMENTS

Figure 1:
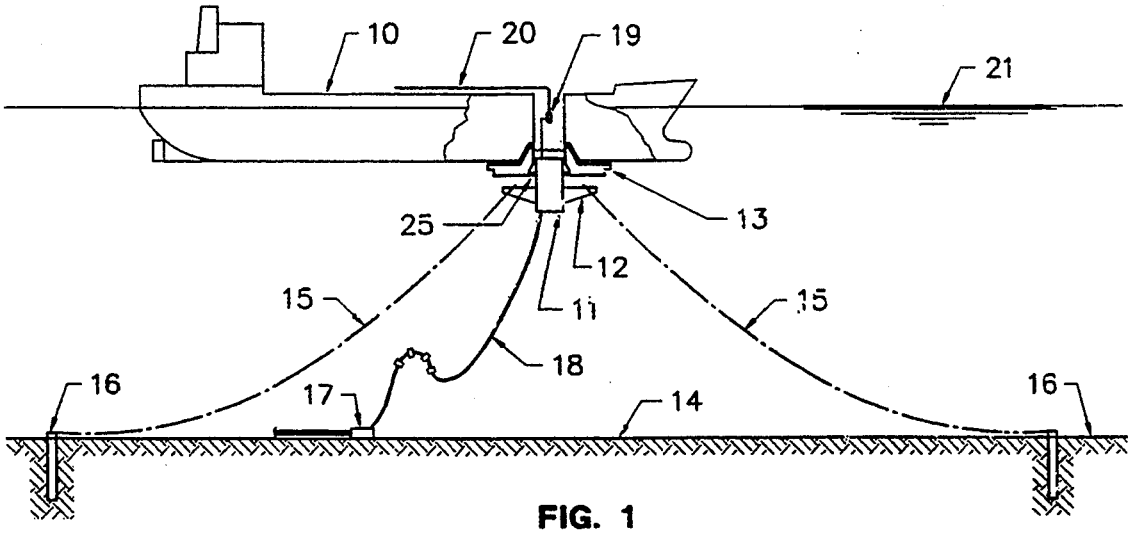
FIG. 1 is a side elevation view of a vessel partially cut away to show a mooring element engaged with a mooring recess in the hull of the vessel in a mooring system according to the invention.

The invention relates to a mooring system such as shown in FIG. 1. This FIGURE shows a vessel 10 moored to a submersible mooring element 11, such as a submersible buoy having a lower part 12 and an upper part 13 secured to the vessel. The lower part 12 is anchored to the sea bed 14 through a series of radially deployed anchor lines 15 anchored to stake piles 16, drag anchors, or other suitable means. The two parts 12 and 13 are relatively rotatable about a vertical axis of the mooring element 11. The vessel 10 may then freely weather vane in response to waves, currents and wind when secured to the upper part 13 of the mooring element.

Fluids are transferred between a pipe line end manifold 17 and the part 12 of the mooring element remaining in a fixed orientation with respect to the sea bed 14 through a flexible pipe riser 18 and a pipe swivel 19 to a piping system 20 on the vessel.

The upper part of the mooring element is preferably formed with a conical surface, either convex or concave, that loosely fits a corresponding mating concave or convex surface formed on the mooring part of the vessel. The mating of the two conical surfaces positions the mooring element properly relative to the vessel.

Figure 2:
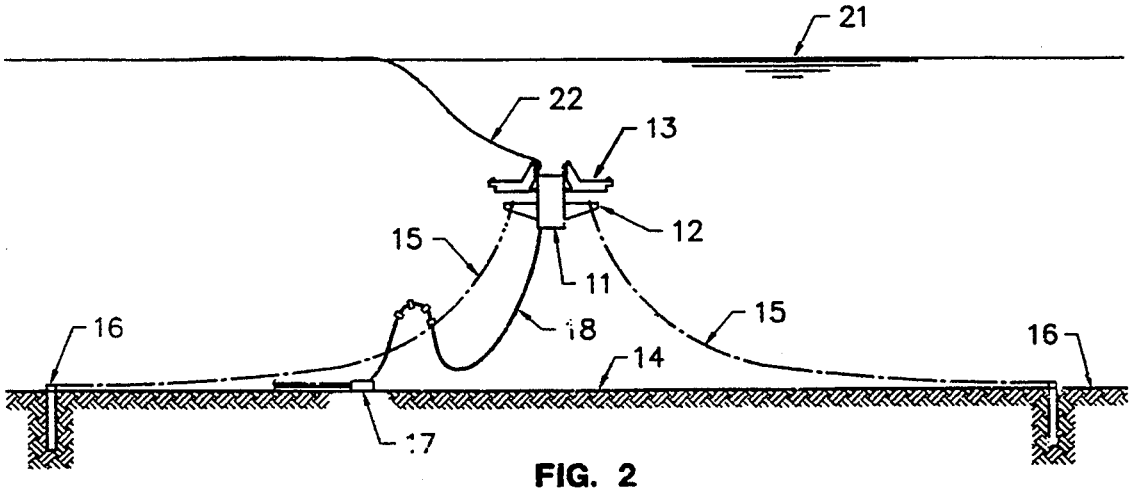
FIG. 2 is a side elevational view of the mooring element without the vessel, the mooring element being maintained submerged at a preselected depth in an equilibrium condition.

FIG. 2 shows the buoyant mooring element 11 trimmed to a position at a depth below the keels of passing vessels when no vessel is moored to the buoy. The mooring element 11 is free floating at a depth below the ocean surface 21 such that there is equilibrium between the upward buoyant forces from the mooring element 11 and a buoyant retrieval rope 22 and the downward forces from the riser 18 and the mooring lines 15 now partially resting on the sea bed 14. The buoyant retrieval rope 22 is attached to the mooring element to permit a vessel to grapple the retrieval rope to haul the buoy up to the keel of the vessel.

Figure 3:
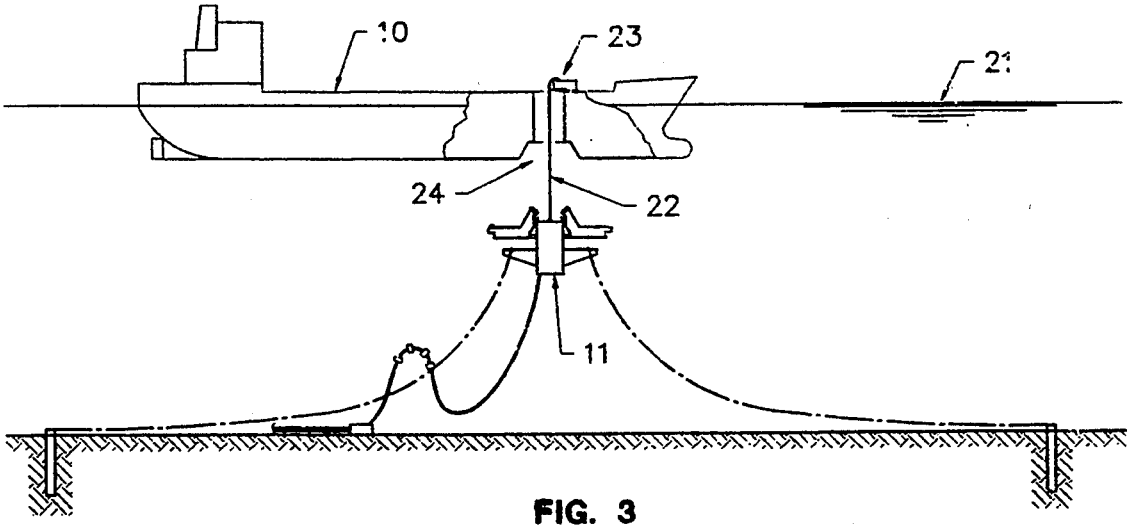
FIG. 3 is a side elevational view of the vessel of FIG. 1 partially cut away to show the mooring element being hoisted from the preselected equilibrium depth towards engagement with the mooring recess in the hull.

FIG. 3 shows the vessel 10 lifting the mooring element 11 into contact with the ,bottom of the vessel 10 by hauling in on the retrieval rope 22 by means of a mooring winch 23. The mooring winch 23 will continue to haul in on retrieval rope 22 until the mooring element is brought into a downward-facing mooring part of the vessel 10, such as a conical recess 24 in the bottom of the vessel. At this position, the vessel may be safely moored to the mooring element for the wave action existing at this time; however, the vessel would not be able to remain moored in this manner if the weather deteriorates. Once the upper part of the mooring element 11 is brought into position in the conical recess 24, the mooring winch 23 will be maintained at maximum pull while the securing process explained with reference to FIG. 4 takes place.

Figure 4:
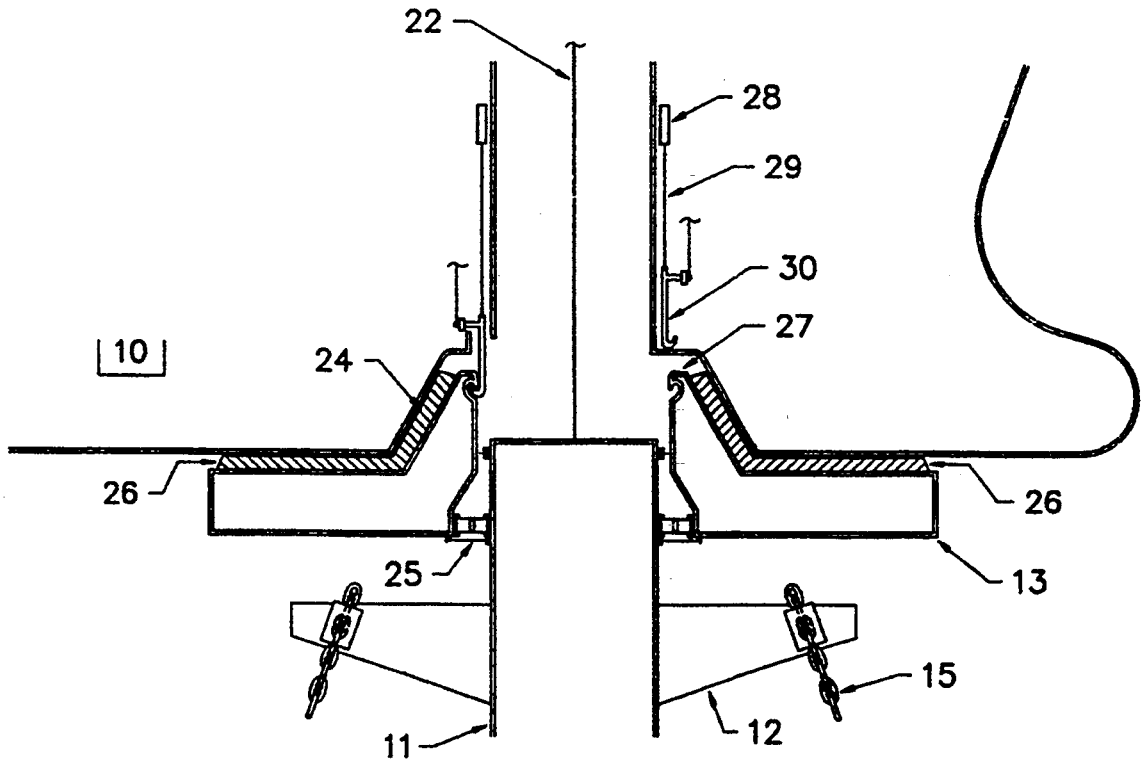
FIG. 4 is an enlarged partial side elevational view in cross section of the vessel and mooring element of FIG. 1 showing details of construction of a first embodiment of securing apparatus of the mooring system.

FIG. 4 shows the final stage of the mooring process in more detail. The upper part 13 of the mooring element 11 is held in intimate contact with the conical mooring recess 24 in the vessel 10 by maintaining tension in retrieval line 22. A number of circumferentially deployed actuators, such as hydraulic cylinders 28, are attached to the upper ends of respective elastic mooring ropes 29, each fitted at its lower end with a hook 30 designed to engage a downwardly protruding mooring ring 27 in the upper part 13 of mooring element 11. The elastic mooring ropes may be, for example, conventional five-inch or six-inch nylon mooring hawsers.

The mooring element 11 is fitted with a resiliently compressible member 26, for example consisting of standard rubber dock fender material, which engages the walls of the mooring recess 24 and the bottom of vessel 10 in compression. Preferably, the resilient member makes a circle of sealing contact with the mooring part of the vessel so that seawater can be pumped out of any vessel spaces open to the mooring part after the mooring element is secured to the vessel.

The final stages in the mooring process consists of stroking each cylinder 28 down so the respective hook 30 moves from an upper position (as shown on the right side of FIG. 4) to a lower position (as shown on the left side of FIG. 4) to engage the mooring ring 27. Following the downstroke, the hydraulic cylinder is stroked up, stressing the elastic mooring rope 29 and stretching it like a spring. The elastic ropes are lowered in pairs at opposite sides of the mooring ring to ensure a balanced force on the mooring element. As each pair of elastic elements is engaged, the securing apparatus takes an incrementally increased share of the mooring load, and the pull on the retrieval rope may be discontinued when a sufficient number of elastic elements have been engaged. When all of the hooks are engaged, the combined forces in all the elastic mooring ropes 29 should exceed the maximum net anchoring forces (i.e., total of the maximum design tensions in the anchor lines 15 and the risers 18 less the net buoyancy of the mooring element), thereby maintaining the mooring element 11 in intimate contact with the vessel 10 and securely mooring the vessel to the sea bed 14 under even the most extreme of design weather conditions.

The elasticity of the elastic mooring ropes 29 preferably is much larger than the elasticity of the compressible member 26, so that the forces in the elastic mooring ropes will change only little in response to changing forces in the anchor lines 15 due to motion of the vessel 10. Thus, the variation in mooring forces from the anchor lines 15 results only in variation of the distribution and magnitude of compressive forces transmitted through the elastic compressible member 26. Consequently, the mooring element 11 is at all times held in intimate contact with the vessel 10 so long as the initial compression force in the compressible member exceeds the maximum net anchoring force.

Figure 5:
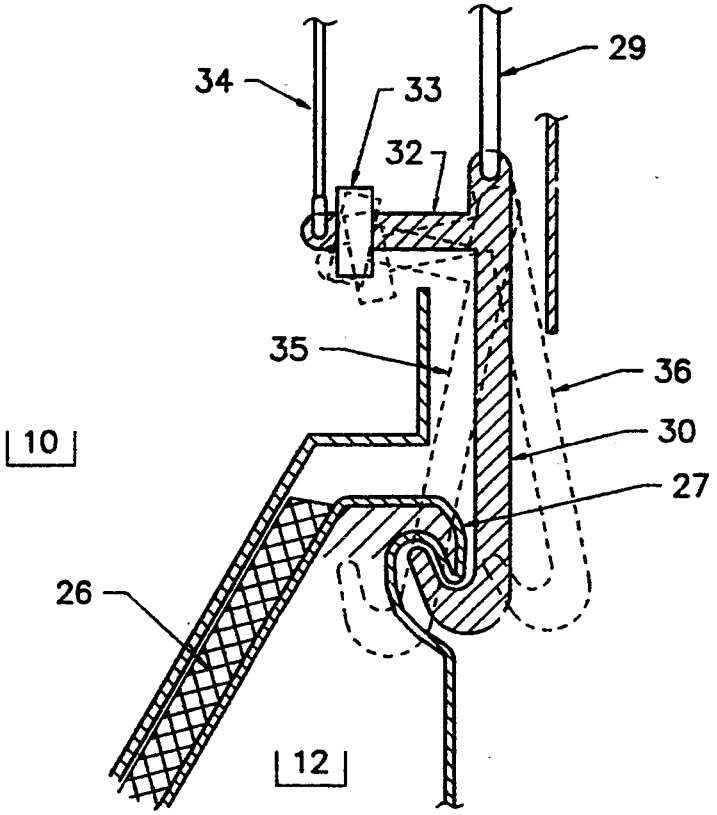
FIG. 5 is a still further enlarged side elevational view of a detail of the securing apparatus of FIG. 4.

FIG. 5 shows in more detail a mechanism for ensuring that the hook 30 engages the mooring ring 27 upon mooring and that the hook 30 disengages the mooring ring 27 upon unmooring. The mooring hook 30 is fitted with an arm 32 near the top of the hook, with a weight 33 on the arm such that the center of gravity of hook 30 is under the arm. The hook is secured to two ropes, the top of the hook to the elastic mooring rope 29 and the end of the arm 32 to an auxiliary mooring rope 34, which need not be elastic.

When the hook 30 is supported by only the elastic mooring rope and is not constrained by any guides or structures, it will assume a position 36 away from the mooring ring 27; whereas when the hook 30 is supported by only the auxiliary mooring rope 34 it will assume a position 35 toward the mooring ring 27. When the hook 30 is lowered by the auxiliary rope 34, while maintaining the main elastic rope 29 slack, it will engage the mooring ring 27. If a slight upward force is then applied to the auxiliary rope 34 the hook 30 will securely engage the mooring ring 27, at which time the main elastic rope 29 will be stressed to maintain the hook securely engaged. The auxiliary rope 34 will then be slackened.

Unmooring may take place by temporarily stressing the retrieval line 22 to hold the mooring element against the hull, or by engaging other temporary means of mooring (not shown), and then slackening each of the main elastic ropes 29. The respective hooks 30 will then disengage from the mooring ring 27 and assume a position similar to 36 away from the mooring ring 27. Upon retraction of each hydraulic actuator 28, the respective hook will be raised to the upper position. After all hooks 30 have been released and raised in this manner, unmooring can proceed by releasing the retrieval line 22.

Figure 6:
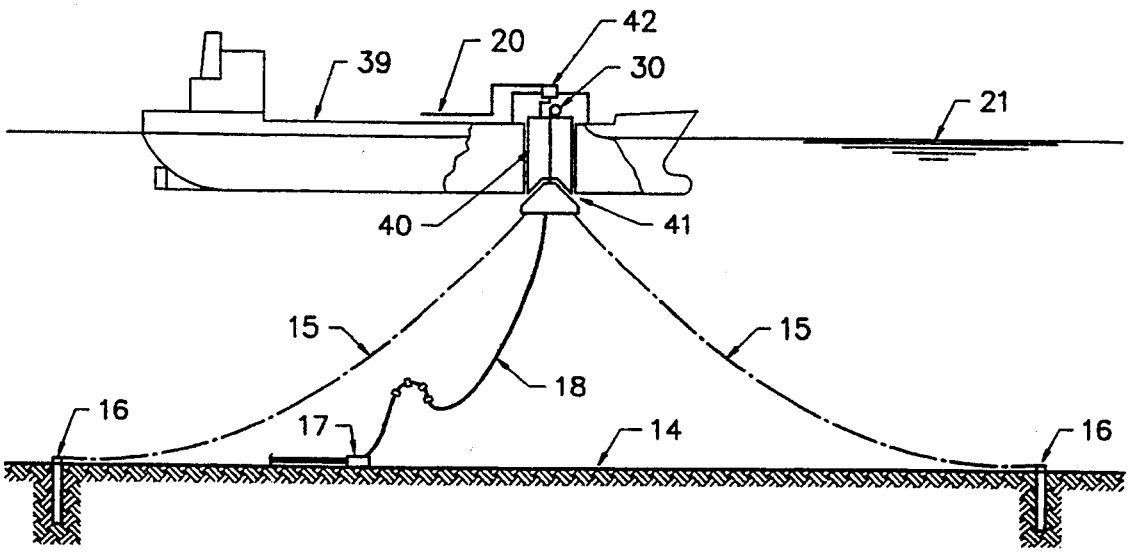
FIG. 6 is an side elevational view, similar to FIG. 1, of a vessel partially cut away to show a second embodiment of the mooring system.

The embodiment shown in FIGS. 1 through 5 has a mooring element provided with a lower part 12 supported from the upper part 13 by a bearing 25 to permit rotation of the vessel 10 with respect to the sea bed 14. FIG. 6 shows a second embodiment of the mooring system in which a vessel 39 is equipped with a turret 40 mounted in the vessel 39 such that it can freely rotate with respect to the vessel about a vertical axis. In this second embodiment, the mooring element 41 may comprise only a single unit, providing no horizontal rotation ability within the mooring element 41 itself. However, when the mooring element 41 is moored to the turret 40, the vessel 39 may freely weather vane about the turret 40.

The mooring element 41 has buoyancy characteristics similar to those of the mooring element 11 shown in FIG. 2, and it is retrieved in a manner similar to that shown in FIG. 3, except the mooring winch 23 is more conveniently mounted on the turret 40 so that no swivel connection is needed for the retrieval line. Fluid transfer connections from the flexible risers 18 is established in the traditional manner through fluid swivels 42 mounted on the deck of vessel 39 to the vessel piping 20. The mooring element is anchored through anchor lines 15 to anchors 16 at the sea bed 14 similar to the way shown in FIG. 1.

Figure 7:
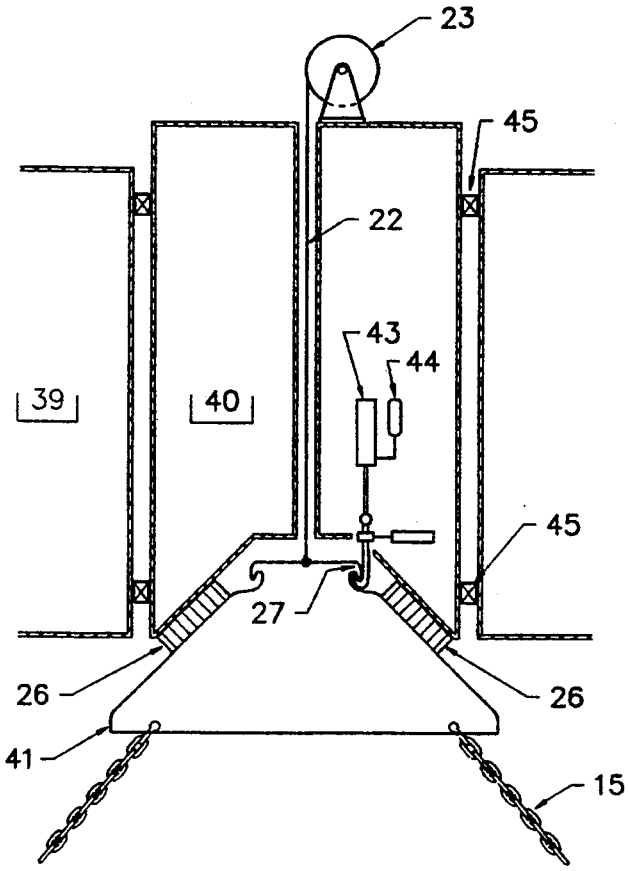
FIG. 7 is an enlarged partial side elevational view in cross section, similar to FIG. 4, showing details of construction of the second embodiment of the mooring system.

FIG. 7 shows in more detail the apparatus for securing the mooring element 41 to the turret 40. The turret 40 is mounted rotatably in the vessel 39 through upper and lower bearings 45. For the sake of illustrating a different way of configuring the mooring element, the upper part, including the resiliently compressible member 26, is conical rather than the combination of conical and plane surfaces of the first embodiment, as shown in FIG. 4.

In the second embodiment, there is a rigid connection between hydraulic cylinder 43 and the hook 30, and the elasticity of the securing apparatus is achieved by operating the hydraulic cylinder in two modes: an operations mode, in which the cylinder is stroked up or down by external hydraulic power (not shown) supplied to the cylinder 43, and a securing mode, in which the cylinder is powered upwards by means of an accumulator 44 that provides an almost constant upward force, even when changing anchor line tensions force the cylinder either to pay out or to retract. It would normally not be considered safe to use hydraulic cylinders in this second mode in a mooring system, due to the danger of losing hydraulic power through leaks. However, since this system relies on a number of elastic connectors and since the number typically would be fairly large, such as 12 or more, the loss of one cylinder would not result in sufficient degradation of the mooring capacity to initiate failure.

Figure 8:
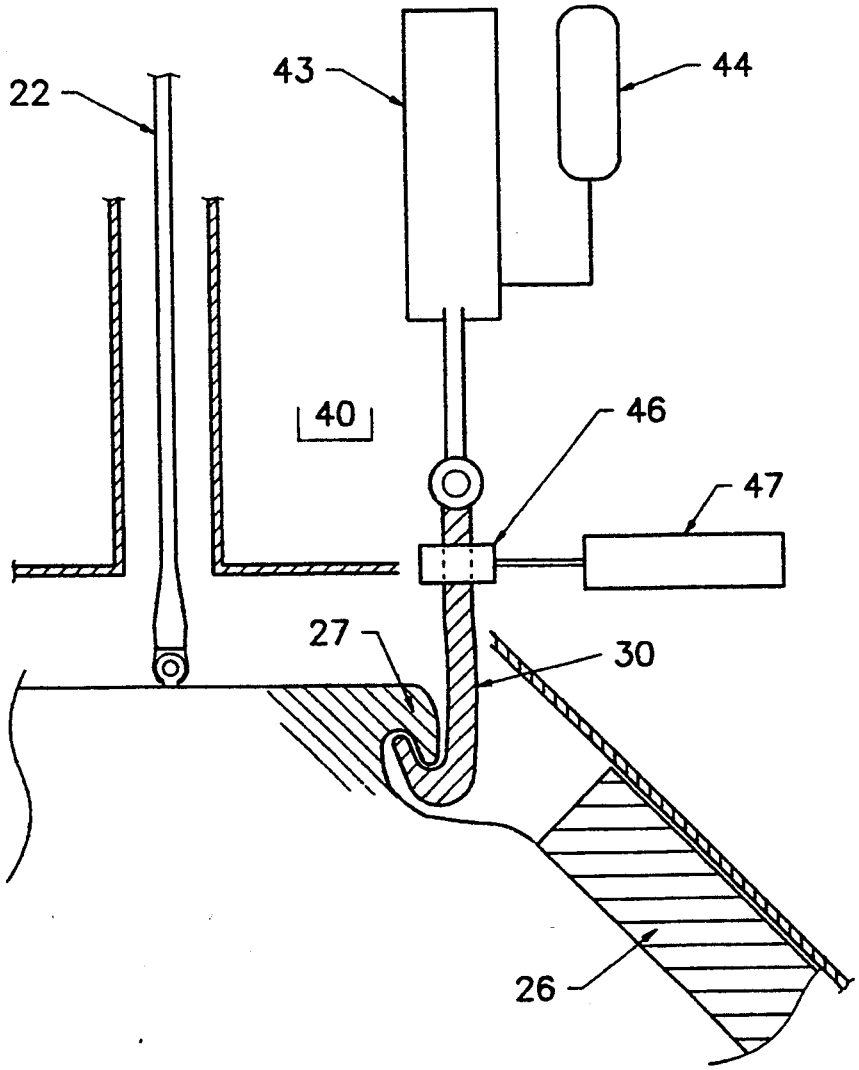
FIG. 8 is a still further enlarged side elevational view of a detail of the securing apparatus of FIG. 7.

FIG. 8 shows in more detail the mechanism of the second embodiment for ensuring that the hook 30 engages the mooring ring 27 when mooring and that the hook 30 disengages when unmooring. In this case, the mooring hook 30 is held by a hook guide 46 in which the hook 30 can slide up or down. The hook guide 46 is connected to a hydraulic cylinder 47 which, when stroked out, presses the hook against the mooring element 41, thereby forcing the hook to engage the mooring ring 27 when the cylinder 43 is first stroked down and then up. When unmooring, the mooring element 41 is held temporarily by, for example, the retrieval rope 22 or by other means not shown. Each cylinder 43 is first stroked down; cylinder 47 is then retracted, removing the hook 30 from the mooring element 41. Whereupon each cylinder 43 is stroked up to retract the hooks 30, making it safe to pay out the retrieval rope 22 to unmoor.

Several embodiments and variations of the invention have been described as illustrative examples. Various modifications may be effected within the spirit and scope of the invention. For example, relatively stiff wire ropes could be substituted for the elastic ropes 29 of the first embodiment, so long as the deformation of the compressible member 26 under the initial preload of the upstroked hydraulic cylinders 28 is enough to compensate for any subsequent deformation of structural elements of the vessel located between the hydraulic cylinder mountings and the mooring ring of the mooring element due to heavy weather. In this case, the compressible member itself is sufficiently elastic to maintain intimate contact between the mooring element and the vessel despite deformations of the vessel structure.

Although a retrieval line has been shown as a means for raising a submersible mooring element from the stowed position into contact with a mooring part of a vessel, the mooring element also could be raised by displacing ballast water with compressed air to increase its buoyancy, or by a combination of a retrieval line and deballasting.

Finally, the mooring part of the vessel has been shown as being located on the bottom of the vessel hull near the bow, which is the preferred location. The mooring part can be located elsewhere, however, including on a separate structure attached to the bow or stern. Accordingly, the invention is limited only by the accompanying claims.

I claim:

1. An ocean mooring system including a submersible buoyant mooring element having an upper part symmetrical about a vertical mooring axis of the mooring element;

a vessel having a downward-facing mooring part symmetrical about a mooring axis of the vessel and engageable with the upper part of the mooring element;

apparatus for securing the upper part of the mooring element to the mooring part of the vessel, wherein the securing apparatus comprises:

a downwardly-facing annular mooring surface on the upper part of the mooring element coaxial with the mooring axis of the mooring element;

a multiplicity of actuators mounted in the vessel;

a multiplicity of hooks disposed concentrically with the mooring axis of the vessel, with means for connecting at least one hook to each actuator for movement by the actuator between a raised position and a lowered position; and apparatus for radially shifting each hook in one direction to engage the mooring surface during a mooring operation and in an opposite direction to disengage from the mooring surface during an unmooring operation, wherein the multiplicity of actuators, when actuated to move their respective hooks to the raised position when the hooks are engaged with the mooring surface, exert a total tension force that is greater than a predetermined maximum downward force exerted by the mooring element on the hooks.

2. An ocean mooring system according to claim 1 wherein at least one of the mooring part of the vessel and the upper part of the mooring element includes a resilient compressible member that cushions any impact of the upper part of the mooring element against the mooring part of the vessel to avoid or minimize damage to the two parts.

3. An ocean mooring system according to claim 2 wherein the resilient member makes a circle of sealing contact with the mooring part of the vessel so that seawater can be pumped out of any vessel spaces open to the mooring part after the mooring element is secured to the vessel.

4. An ocean mooring system according to claim 2 wherein the means for connecting each hook to the respective actuator is an elastic rope.

5. An ocean mooring system according to claim 2 wherein the multiplicity of actuators, connecting means, and hooks of the securing apparatus have an effective total tensile elasticity that is greater than the compressive elasticity of the compressible member to insure that the hooks maintain a net compressive force on the resilient member under even extreme wave action acting on the vessel.

6. An ocean mooring system according to claim 2 wherein the actuators are hydraulic actuators, and each actuator is provided with an hydraulic accumulator for supplying substantially constant actuating pressure when the hooks are engaged with the mooring surface in the raised position.

7. An ocean mooring system according to claim 1 wherein the mooring part comprises a turret that is rotatably mounted in the vessel so that the vessel may weather vane by rotating about the turret.

8. An ocean mooring system according to claim 1 wherein the mooring element has a lower part that is rotatable relative to the upper part about a vertical axis, and anchor lines are fixed to the lower part, thereby permitting the vessel to weather vane with respect to the anchor lines.

9. An ocean mooring system according to claim 1 wherein one of the mooring part of the vessel and the upper part of the mooring element has a convex surface and the other has a loosely mating concave surface.

* * * * *